US006076685A

United States Patent [19]

Ramirez

[11] Patent Number: 6,076,685

[45] Date of Patent: Jun. 20, 2000

[54] DEVICE TO HOLD HAIR ACCESSORIES AND OTHER SMALL GROOMING AIDS

[76] Inventor: Amy Ramirez, 13 Oxford La., Harriman, N.Y. 10926

[21] Appl. No.: 09/084,640

[22] Filed: May 26, 1998

[51] Int. Cl.[7] ..... A47F 7/00; A47F 7/19; A47F 5/08

[52] U.S. Cl. ..... 211/13.1; 211/85.3; 211/113

[58] Field of Search ..... 211/13.1, 85.2, 211/85.3, 85.29, 113, 117, 104; 206/6.1, 554, 260; 248/317, 323, 327

[56] References Cited

U.S. PATENT DOCUMENTS

| | | | |
|---|---|---|---|
| 3,709,373 | 1/1973 | Aguilar | 211/113 |
| 3,790,045 | 2/1974 | Rigel et al. | 211/13.1 X |
| 4,375,110 | 3/1983 | Murphy | 403/291 X |
| 4,519,564 | 5/1985 | Nadherny | 248/327 X |
| 4,561,548 | 12/1985 | Call | 211/70.7 |
| 5,094,414 | 3/1992 | Eddy, Jr. | 211/113 X |
| 5,226,858 | 7/1993 | Snowdon | 206/554 X |
| 5,452,806 | 9/1995 | Campas | 211/13.1 |

*Primary Examiner*—Daniel P. Stodola
*Assistant Examiner*—Erica B. Harris
*Attorney, Agent, or Firm*—Sandra M. Kotin

[57] ABSTRACT

A device for the storage and display of hair accessories. The device utilizes pairs of filled long fabric tubes twisted about each other and tied at each twist point to retain the twisted conformation. The pairs of twisted tubes are clamped in a frame that is fitted with a hook so the device can be hung in a closet or on a wall or door. Barrettes and hair clamps can be fastened about the tubes while scarfs, scrunchies and crushable hats can be placed between the tubes in the sections delineated by the ties. A transparent pouch suspended from the hook can hold smaller items such as hair pins and rubber bands and enables the user to view the contents thereof.

8 Claims, 3 Drawing Sheets

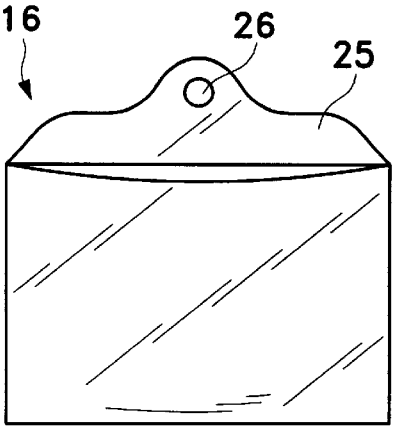
Fig. 3
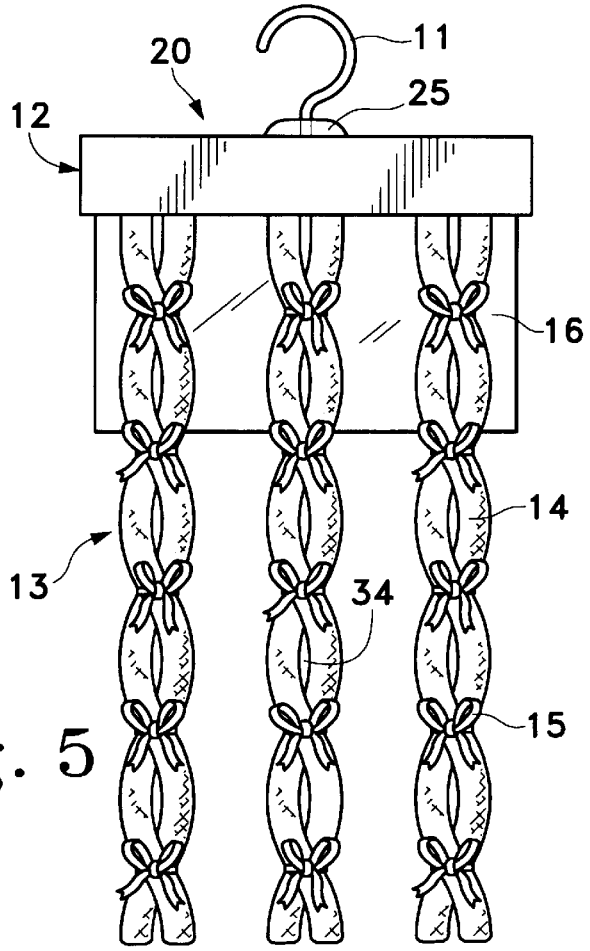
Fig. 5
Fig. 4
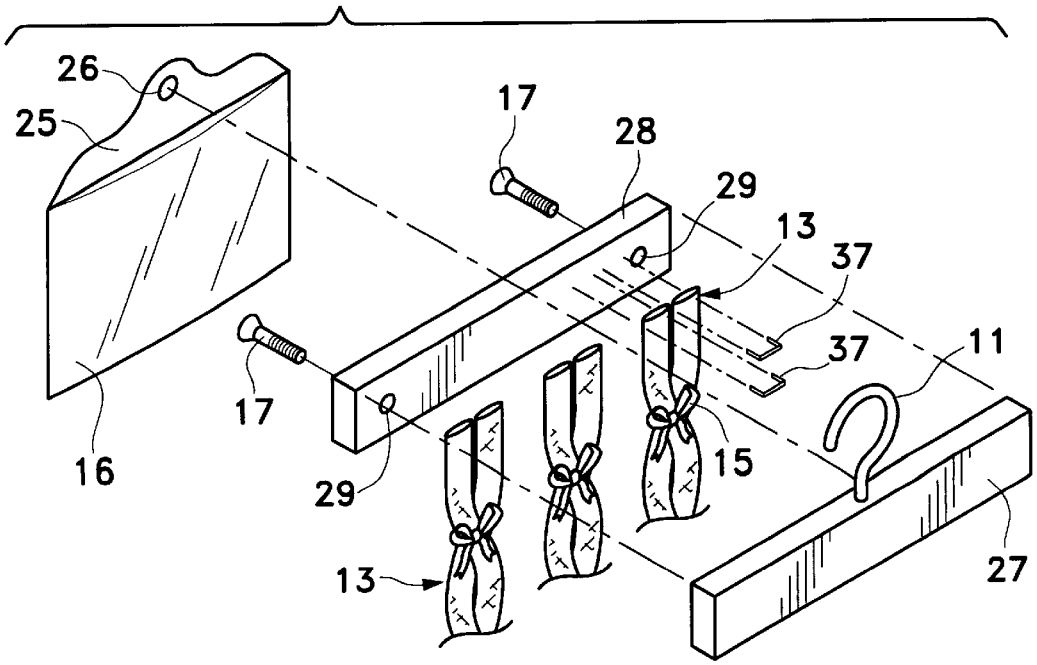

Fig. 6
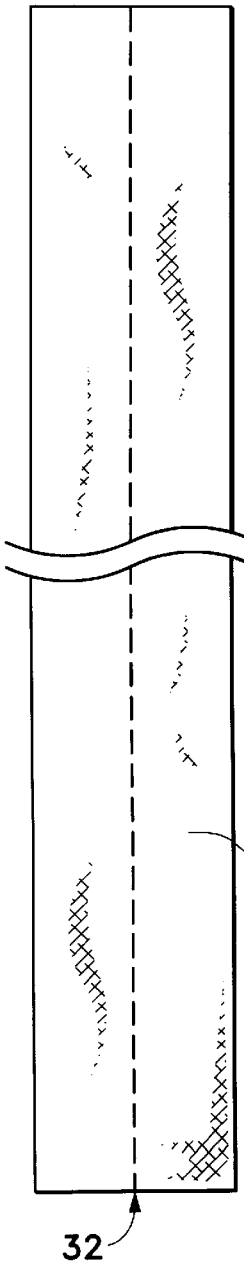
Fig. 7
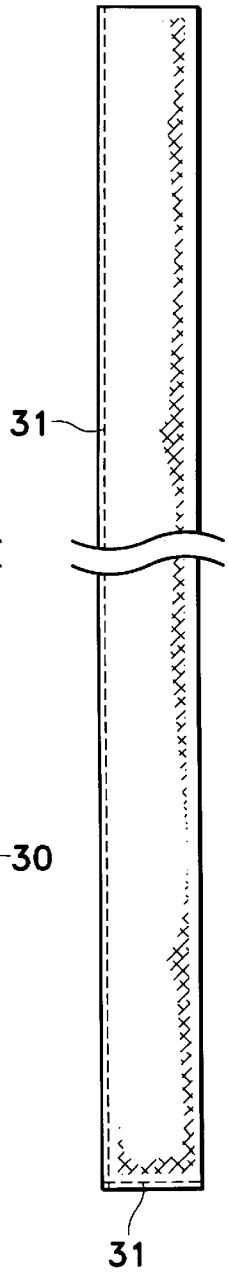
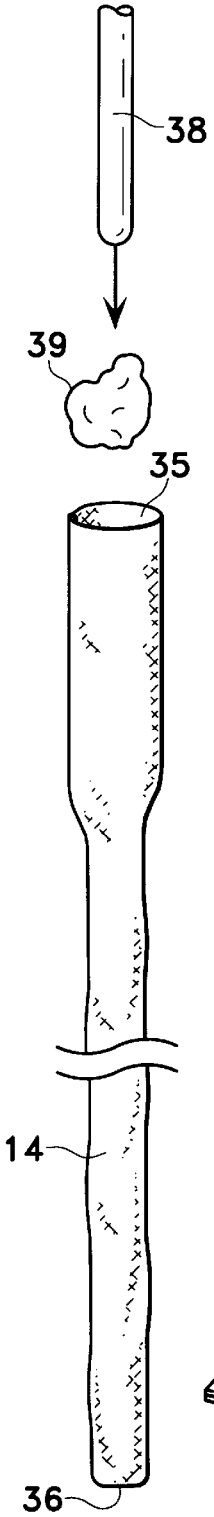
Fig. 8
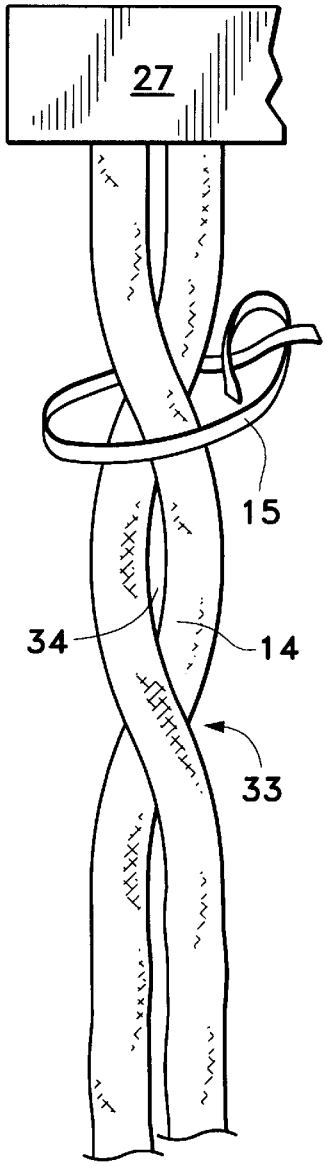
Fig. 9
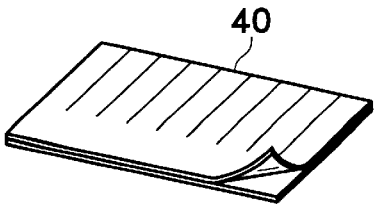
Fig. 10

DEVICE TO HOLD HAIR ACCESSORIES AND OTHER SMALL GROOMING AIDS

FIELD OF THE INVENTION

The instant invention relates to an aesthetically pleasing device for displaying and holding a variety of hair accessories and other small grooming aides and the method of manufacture of same.

BACKGROUND OF THE INVENTION

As long as women have used accessories to adorn their hair they have needed some means of containing or displaying those accessories. This was usually accomplished with a box or shelf. Victorian women used elaborate vanity boxes that were often just one part of the vanity sets that were openly set out on their dressing tables.

Gonzales, in U.S. Pat. No. 5,031,758, devised a yarn braid to which small objects could be clamped or pinned. She attached the braid to a display board on which were also mounted boxes and holders for objects that could not be attached to the braid.

A vertical holding device for ornaments, jewelry, scarfs and the like that uses long strips of hook and loop type fasteners attached to a base panel of fabric is taught by Daniels. The hook and loop type fastening strips can be pulled into loops to hold the articles. (U.S. Pat. No. 5,117,988) This device is not practical for use with delicate fabrics such as silk scarfs because they can be pulled and damaged by the fastening strips.

At one time salesmen of ladies' hair ornaments used their own display means to show their wares. Gutterman in U.S. Pat. No. 1,574,192 teaches a display pad for barrettes. The pads had stiff backing and interior cushioning with stiff holding strips on which to clamp the barrettes. Several of such pads could be stacked in a case. Today's hair accessories have expanded far beyond barrettes and such display means would not be adequate for all of the products now available.

Additional products for use as vertical display means but not practical for hair ornaments and scarfs are: a multiple coat hanger support that is a wire with evenly spaced coils (U.S. Pat. No. 2,609,104 to Leach); a wall display device made of long strips of mesh to which can be attached hooks for pictures, record albums and the like (U.S. Pat. No. 3,853,226 to Hine et al.); and a doll pole consisting of a fabric tube with interior rods to maintain the tube as a pole, and with ribbons attached at intervals which can be tied around the dolls so they can be displayed (U.S. Pat. No. 4,749,088 to Workman et al).

There is a need for a device to hold and display a variety of hair accessories such as barrettes, combs, clamps, scrunchies and scarfs, as well as small objects like hair pins and rubber bands, so that all can be neatly arranged and at the same time clearly visible to the user. There is also a need for such a device that is attractive enough to be hung in plain view and that adds to a room's decor at the same time as it provides the useful and easily accessible storage and display capacity for the accessories.

BRIEF SUMMARY OF THE INVENTION

The present invention is directed to a clamping frame from which depends one or more decorative, vertically hanging arms, on which a wide variety of hair accessories and scarfs can be stored and displayed, in combination with a support hook and a transparent pouch to hold small objects such as hair pins and the like. The number and lengths of the arms can be selected to meet the needs of the user and in consideration of the space available for hanging and displaying the device.

It is an object of the present invention to provide a means to store and display a wide variety of hair accessories such as barrettes, clamps, scrunchies, combs and various pins such that they are all easily seen and accessed.

Another object of the present invention is to be able to hang the device anywhere, from a closet bar, over a door or on a wall hook.

It is a further object of the present invention that the display device be attractive enough enhance a room's decor.

It is a still further object of the present invention that the device can be made from a variety of readily available materials so as to match, contrast or complement any type of decor.

Another object of the present invention is to have the device made of such materials that hair accessories and scarfs made of fine fabrics will not be snagged or damaged in any way from contact with the device.

A further object of the present invention is to enable the accessories to be easily affixed to the device and just as easily removed therefrom so that even a young child can use it.

A still further object of the present invention is to have the hanging arms completely flexible so the device can be folded for packaging or transport.

It is a further object of the present invention that the accessories be held securely in place so that the device can be moved from one place to another without dislodging or losing them.

Another object of the present invention is to have a device that is easy and inexpensive to manufacture.

A further object of the present invention is to have flexibility in the extent of the holding spaces so that accessories of various sizes can be accommodated in the same spaces.

Other features and advantages of the invention will be seen from the following description and drawings.

BRIEF DESCRIPTION OF THE DRAWINGS

FIG. 3 is a front elevation view of the transparent pouch.

FIG. 4 is an exploded perspective view of a second embodiment of the present invention illustrating the relationship of the parts.

FIG. 5 is a front elevation view of the second embodiment of FIG. 4.

FIG. 6 is a fragmentary plan view of a piece of fabric cut to form a tube.

FIG. 7 is a fragmentary plan view of the fabric of FIG. 6 folded longitudinally and stitched to form a tube.

FIG. 8 is a fragmentary perspective view of the tube of FIG. 7 inverted, opened and ready to be filled with the assistance of a wooden dowel.

FIG. 9 is perspective view showing how two tubes are twisted and tied to form one of the arms.

FIG. 10 is a perspective view of the instruction sheets.

DETAILED DESCRIPTION OF THE INVENTION

Figure 1:
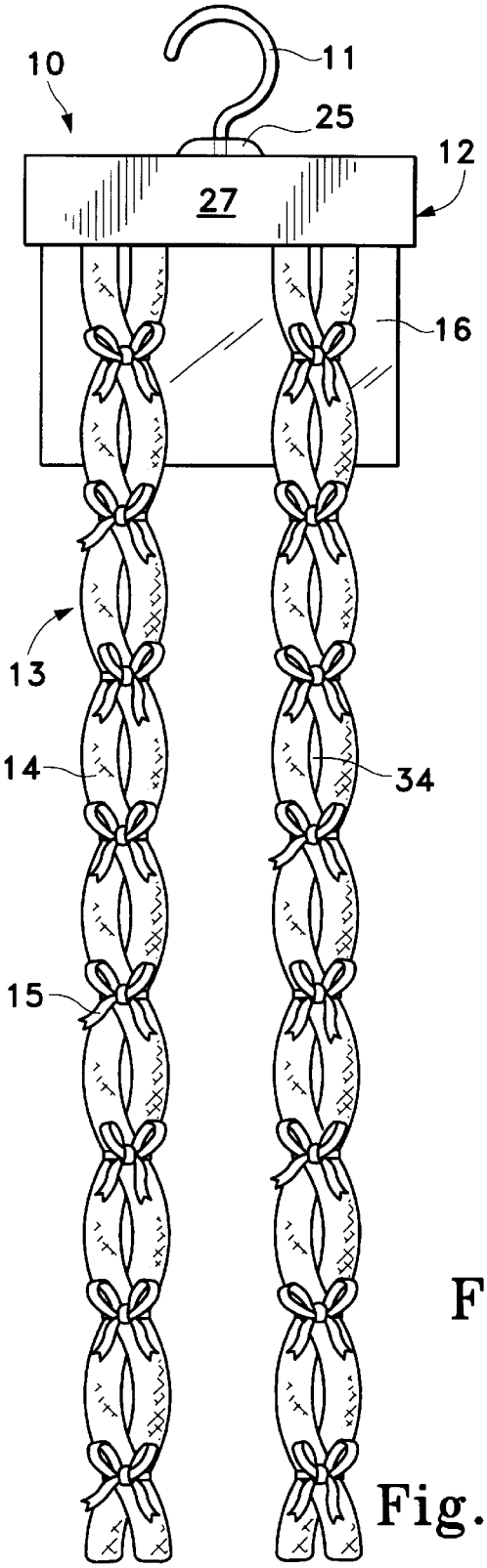
FIG. 1 is a front elevation view of one embodiment of the present invention.

One embodiment of the hair accessory holder 10 is illustrated in FIG. 1, and a second embodiment 20 is shown in FIG. 5. A support hook 11 is used to hang the device on a closet bar, over a door or on a variety of wall hooks or rods. The support hook 11 is attached to a clamping frame 12 that consists of a front panel 27 and a back panel 28 that are held together by screws 17 as seen in FIG. 4, or other means known in the art. One or more elongated arms 13 hold the various hair accessories. The top portion of each arm 13 is securely attached to and further clamped in the frame 12 and the remainder of the arm depends therefrom.

Each arm 13 is composed of two flexible filled fabric tubes 14 that are twisted about each other at regular intervals along their lengths. There is a tie 15 about both tubes at each twist point 33 that secures the tubes in the twisted conformation. The tie 15 can be a ribbon, a string, a rubber band or other securing means known in the art. Ribbons are aesthetically desirable and can be obtained in a wide variety of widths, colors, and patterns. Strips of the same fabric of which the tubes are made can also be used as ties. To achieve a sleeker look, metal rings (not illustrated) can be used to secure each twist point. These can be open rings that are closed securely around the two tubes at the twist points.

The twist points 33 define sections along the arms in which there are openings 34 between the tubes. These openings 34 provide the sites for the insertion of the various hair accessories for storage and display. By fixing the twists in the aforesaid manner, there is some flexibility in the sizes of the openings, since merely using a slight pull at the opening can move the tie 15 or band slightly to provide a wider or longer space, if needed, for the particular accessory being situated therein. If the metal rings are used they can be sized so they are able to slide up and down to the extent necessary to widen or enlarge an opening 34. The device can be sold with the metal rings and the user can thereafter add ribbons to complement her room's decor.

Three tubes may be used to form a braid, but this configuration was found not to be desirable. The regularly spaced ties are not needed in a braid, but the space for placing articles is more rigidly defined, is smaller, and the flexibility of being able to increase the size of the openings that is achieved with the twists and ties is lost with the braid.

The arms 13 can accommodate barrettes 21 by fastening them around a tube 14 and closing the clip. Scrunchies 22 can be placed in the openings 34 between the twisted tubes as well as scarfs, hair ribbons, and even small crushable hats. Hair clamps 19 can be clamped around one tube if the clamp is small and around the entire arm if the clamp is large. These can be seen in FIG. 2.

Figure 2:
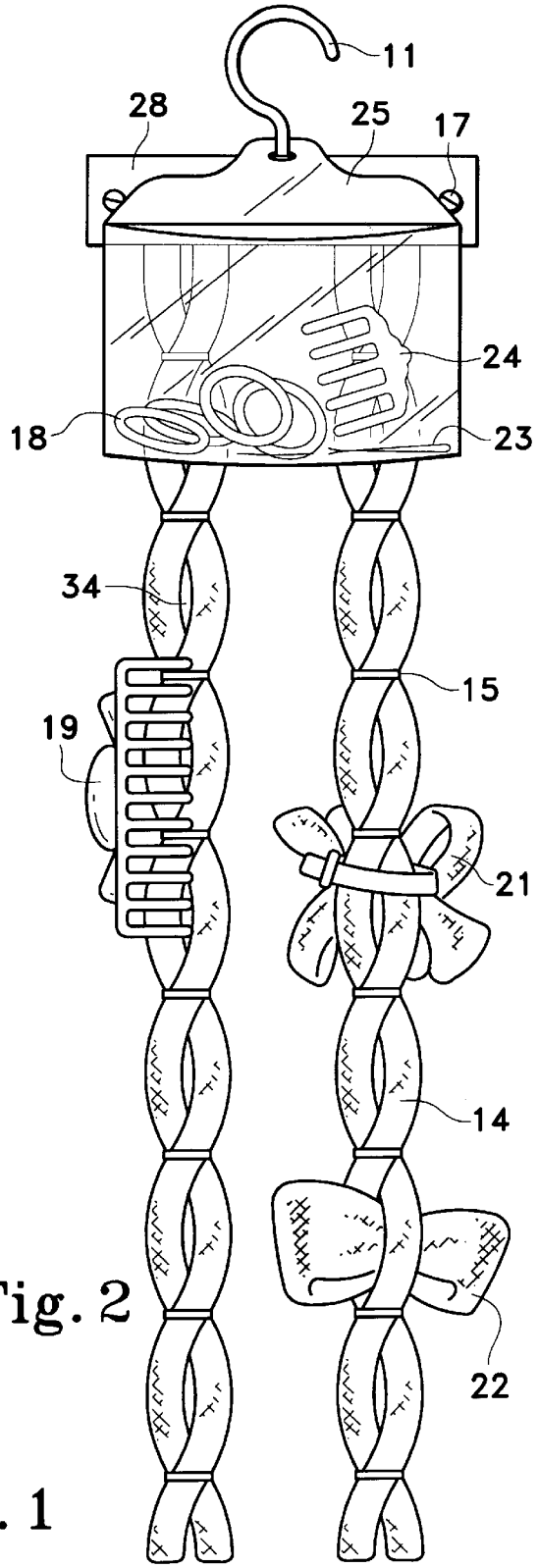
FIG. 2 is a rear elevation view of the embodiment of FIG. 1 with accessories.

Often there is a need to store small hair accessories such as rubber bands 18, small combs 24, bobby pins 23 or very small barrettes. A transparent envelope or pouch 16 is provided for this purpose. The pouch 16, seen in FIG. 3, is rectangular, open at the top, and has a tab 25 extending from one side. There is an opening 26 in the tab 25. The support hook 11 easily fits through this opening 26 so the pouch 16 can be suspended from the support hook 11 either at the front or at the back of the device. The pouch 16 can also be made of a matching or contrasting fabric, but it is advantageous to have it made of a transparent material so that all of the objects contained therein are easily viewed as seen in FIG. 2. The pouch can also be of any desired shape or configuration.

The device of the instant invention can be made with one arm 13, but two or three are preferable. The lengths of the arms can vary, and referring to FIG. 1, there are two long arms, typically 3 feet (1 meter) long, while FIG. 5 shows three shorter arms which can be 2 feet (0.62 m) long. The number and lengths of the arms can be adapted to meet the needs of the user and the space available for hanging the device.

The hair accessory holder of the instant invention is easy to make. Strips 30 of fabric slightly longer than the desired length of a tube 14 and slightly wider than the desired diameter of the tube 14 are cut (FIG. 6) and folded in half along a center fold line 32 with the reverse side of the fabric facing outward. A typical width of such a strip 30 is 2.75 inches (7 cm). The folded fabric is thereafter stitched along the longitudinal edge and one transverse edge (FIG. 7) to form a long narrow tube 14 having an open end 35 and a closed end 36. The stitching 31 should be far enough from the edge of the fabric so that neither the stitching nor the fabric will pull apart when the tube is tightly filled through the open end. Once stitched, the tube is turned inside out. This procedure is quite difficult with such a narrow tube. To make it easier, a wooden dowel is used. The closed end 36 of the tube is fitted over the wooden dowel and the dowel is pushed down into the tube as the fabric is eased around it until the entire tube has been inverted (not illustrated). The dowel is then removed and the tube 14 is ready for filling. The filling can be accomplished with any soft stuffing material known in the art. Typical materials are cotton batting and polyester fiberfill. The tube should be filled until it becomes somewhat stiff but not inflexible. Small quantities of filling material 39 are inserted into the tube through the open end 35 and pressed down using the wooden dowel 38 as seen in FIG. 8, until the tube has been sufficiently filled.

When the desired number of tubes have been prepared, they are fastened in pairs to the back panel 28 of the clamping frame 12. Each tube is attached, at its upper end, to the back panel 28 with a staple 37 using a staple gun. A small nail can also be used, or other means known in the art. The front panel 27 of the clamping frame 12 is thereafter attached to the back panel 28 by means of holding screws 17. Predrilled openings 29 in the back panel 28 and corresponding partial openings in the back of the front panel 27 (not shown) facilitate this step. The support hook 11 can be affixed to the frame 12 before or after the tubes are attached and clamped in place. (See FIG. 4)

The use of the staples 37 to fix the tubes to the inside of the clamping frame guarantees that the tubes cannot slip or be pulled out of the assembled device.

The whole unit can be hung in a convenient place so the tubes can be twisted and tied. Taking one pair of tubes at a time, the two tubes are twisted one about the other, successively crossing one over the other, and tying them at each cross-over point 33 with a ribbon 15 as seen in FIG. 9, or other securing means as noted above. The use of ribbons formed into bows at the front of the device is an aesthetically pleasing way to secure the cross-over points 33. The twisting and tying are repeated along the full lengths of the tubes as seen in FIGS. 1 and 5. This twisting method leaves a number of potential locations or openings 34 along each arm 13 for inserting the hair accessories. As previously noted, because the tubes are merely twisted about each other, the openings can be altered slightly to accommodate a larger accessory by gently pulling at the tubes or pushing the large accessory into an opening 34. This space flexibility makes the instant invention useful for the storage of a wide variety of accessories.

As an alternative method of manufacture, the pairs of tubes can be held in an independent clamping device or by any other means convenient to the maker, twisted and tied, and thereafter the desired number of pairs of tubes or arms 13 can be fixed into the clamping frame 12 as described above.

Once all of the pairs of tubes have been twisted, tied and clamped into place in the clamping frame 12, and the support hook 11 is in place, the transparent pouch 16 is added by inserting the end of the support hook 11 through the opening 26 in the tab 25 and suspending the pouch at the front or rear of the device as the user chooses.

The wide curve of the support hook 11 illustrated in FIGS. 1, 2, 4 and 5 was chosen for this device because it enables the device to be hung in many different locations such as over a closet bar, over a door, or on a hook or nail in a wall. Any other support hook known in the art can be utilized. The clamping frame 12 is typically made of wood, but other strong, rigid material can be used.

All of the parts of the instant invention and their relationship to one another are seen in FIG. 4.

The device of the instant invention is also suitable for sale as a craft kit so that the user can make her own hair accessory holder. Such a kit can take two forms. The first form contains the support hook, clamping frame with holding screws, small nails, transparent pouch, filling material, wooden dowel and illustrated instructions 40 (FIG. 10). The person making the device selects her own fabric and ribbons or other ties. The fabric used could match or otherwise complement the room decor in which the device would be displayed. The second form of the kit contains all of the above noted materials and in addition the necessary fabric and ties. A needle and thread for the stitching could also be included.

While two embodiments of the present invention have been illustrated and described in detail, it is to be understood that this invention is not limited thereto and may be otherwise practiced within the scope of the following claims.

What is claimed is:

1. A device for displaying and storing a variety of large and small hair and grooming accessories comprising:

at least one vertically suspended member formed of two elongated pliable filled tubes, said tubes being repeatedly twisted one about the other forming a multiplicity of twist points and openings between adjacent twist points;

slidably adjustable binding means situated at each twist point to maintain the two tubes in twisted conformation so as to permit the location of the twist points to be changed by slidable adjustment thereof, thereby altering the sizes of the openings;

suspension means for fixedly holding the suspended member; and hanging means for hanging said device in diverse locations;

whereby when a large accessory is placed in one of the openings by the exertion of manual force on the tubes at points about the opening the binding means adjacent the opening move vertically and the opening is enlarged to accept the accessory while an adjacent opening is made smaller for the acceptance of a small accessory and the large and small accessories can be reversibly accommodated by the manual manipulation of the tubes and vertical movement of the binding means for the storage and display of the accessories.

2. A device as in claim 1 further comprising container means for holding accessories that are too small to be retained within the openings, said container means being affixed lo said suspension means such that the contents of said container means may be accessed without its being detached from said suspension means.

3. A device for displaying and storing a variety of large and small hair and grooming accessories, said device being characterized by at least one suspended member, suspension means for fixedly holding the suspended member, and hanging means for hanging said device in diverse locations, wherein said suspended member comprises:

two elongated pliable cylinders, said cylinders being repeatedly twisted one about the other forming a multiplicity of twist points and openings between adjacent twist points; and slidably adjustable binding means situated at each twist point to maintain the two cylinders in twisted conformation so as to permit the location of the twist points to be changed by slidable adjustment thereof, thereby altering the sizes of the openings;

whereby when a large accessory is placed in one of the openings by the exertion of manual force on the cylinders at points about the opening the binding means adjacent the opening move vertically and the opening is enlarged to accept the accessory while an adjacent opening is made smaller for the acceptance of a small accessory and the large and small accessories can be reversibly accommodated by the manual manipulation of the cylinders and vertical movement of the binding means for the storage and display of the accessories.

4. A device as in claim 3 wherein the cylinders are filled tubes.

5. A device as in claim 4 wherein the filling comprises soft resilient filling material.

6. A device as in claim 8 further comprising container means for holding accessories that are too small to be retained within the openings.

7. A device as in claim 6 wherein said container means is affixed to said suspension means such that the contents of said container means may be accessed without its being detached from said suspension means.

8. A kit with instructions for the manufacture of a device for displaying and storing a variety of large and small hair and grooming accessories, said device being characterized by at least one elongated member formed from two elongated pliable fillable tubes twisted about each other all along their lengths forming a multiplicity of twist points and openings between adjacent twist points, said kit comprising:

a quantity of pliable material sufficient to form at least two tubes;

means to maintain the pliable material in tubular conformation;

soft resilient filling material for filling the tubes;

rod means to assist in inverting and filling the tubes wherein said rod means is used to tamp the filling material into the tubes;

support means for supporting and suspending the elongated filled tubes;

hanging means for hanging the device in diverse locations;

container means for holding small accessories; and binding means for binding the tubes at each twist point so that the tubes are maintained in twisted conformation with the openings between the adjacent twist points and such that the binding means are slidably adjustable by the exertion of force on the tubes so as to reversibly alter the size of the openings.

* * * * *

UNITED STATES PATENT AND TRADEMARK OFFICE

CERTIFICATE OF CORRECTION

PATENT NO. : 6,076,685
DATED : June 20, 2000
INVENTOR(S) : Amy Ramirez

It is certified that error appears in the above-indentified patent and that said Letters Patent is hereby corrected as shown below:

Column 6, line 26, after "as in claim" delete "8" and substitute --3--.

Signed and Sealed this

Third Day of April, 2001

*Attest:*

Nicholas P. Godici

NICHOLAS P. GODICI

*Attesting Officer*

*Acting Director of the United States Patent and Trademark Office*